US005216894A

United States Patent [19]

Kim

[11] Patent Number: 5,216,894

[45] Date of Patent: Jun. 8, 1993

[54] CONTROL SWITCH

[75] Inventor: Wan S. Kim, Kyungki, Rep. of Korea

[73] Assignee: Samsung Electronics Co., Ltd., Suweon, Rep. of Korea

[21] Appl. No.: 959,362

[22] Filed: Oct. 13, 1992

[30] Foreign Application Priority Data

Oct. 18, 1991 [KR] Rep. of Korea ..... 91-17421[U]

[51] Int. Cl.[5] ..... F25B 49/02

[52] U.S. Cl. ..... 62/129; 62/126; 62/228.3

[58] Field of Search ..... 62/129, 125, 126, 127, 62/228.1, 228.3, 226, 227; 361/22

[56] References Cited

U.S. PATENT DOCUMENTS

| | | | |
|---|---|---|---|
| 3,508,236 | 4/1970 | Adams | 62/129 X |
| 4,745,765 | 5/1988 | Pettitt | 62/129 |
| 4,966,013 | 10/1990 | Wood | 62/126 |
| 5,009,074 | 4/1991 | Goubeaux et al. | 62/126 |
| 5,044,168 | 9/1991 | Wycoff | 62/129 X |

*Primary Examiner*—Harry B. Tanner
*Attorney, Agent, or Firm*—Burns, Doane, Swecker & Mathis

[57] ABSTRACT

A control switch comprises a bellow which contracts and expands pressure of the refrigerant, a lock/unlock member which cooperates with the existence of the pressure of the refrigerant, a spring for forcing the lock-/unlock member against the pressure of the bellow, and a rotatable shaft operatively disposed through the lock-/unlock member. The lock/unlock member has an unlock slot proximate the bellow, a lock slot distal the bellow, and a tapered transition portion between the unlock slot and the lock slot. The shaft is a polygonal, e.g. hexagonal, which fits into the lock slot when the pressure of the refrigerant is under a predetermined value. The user is made aware of the leakage of the refrigerant by the restriction of the rotation of shaft or a break in the power circuit, or both. This prevents the operation of an inefficient in the air conditioner.

6 Claims, 4 Drawing Sheets

CONTROL SWITCH

FIELD OF THE INVENTION

The present invention is related to a control switch for sensing refrigerant leakage from a refrigerant tube in an air conditioner, and more particularly to a control switch that provides a lock means to prevent operation when the refrigerant has leaked from the refrigerant tube, indicating an abnormally low refrigerant pressure.

BACKGROUND OF THE INVENTION

Generally, in an air conditioner utilizing a refrigeration cycle, such as a refrigerator, a dehumidifier etc., pressurized refrigerant gas is in the tube which comprises part of the air conditioner device. The cooling cycle comprising compression, condensation, expansion and evaporation is operated successively so as to undergo the predetermined work. During the refrigerant gas circulation in the cycle, refrigerant gas leaks out through a cracked or defective part of the tube. Notwithstanding the loss of all or part of the refrigerant gas, the apparatus keeps on operating. Thus, the user can not immediately determine the leakage. This causes a waste of electricity in powering an inoperable device. Further, air gets into the tube through the leak whether or not in operation. Moisture in the air promotes oxidation or corrosion of the refrigerant tube, piston or cylinder in the compressor. This adversely effects to compression efficiency, endurance of parts etc.. Moreover, the formation of corrosion material clogs the capillary tube.

SUMMARY OF THE INVENTION

This invention seeks to provide an apparatus which easily and effectively solves the above mentioned problems.

The object of the present invention is to provide a control switch in which a lock/unlock means has a lock slot so as to engage the control shaft in the event the pressure of the refrigerant falls below a predetermined value, thereby easily indicating leakage through cracked tube or the like so as to prevent unnecessary operation, and solving the problems related to the performance of the cooperating parts plus increasing the life thereof.

According to the present invention, the control switch comprises an expansion and contraction means operatively connected to the refrigerant pipe so as to exhibit expansion and contraction according to the pressure of the refrigerant to the expansion and contraction means. The control switch further comprises a lock/unlock means arranged with a proximal portion between the expansion and contraction means and the lock/unlock means so as to longitudinally exhibit movement according to expansion and contraction of the expansion and contraction means for locking/unlocking the rotation of the shaft. The control switch furthermore comprises a spring which urges the lock/unlock means into the lock portion.

The lock/unlock means comprises an unlock slot proximally positioned from the expansion and contraction means and a lock slot distally positioned from the expansion and contraction means. The unlock slot constitutes a wider width than that of the lock slot. Between the slots is provided a tapered transition.

The polygonal portion of the shaft has six or more even numbered sides formed at the distal end of the shaft so as to fit in the lock slot to prevent rotation of the shaft.

In the above structure, under normal pressure of the refrigerant tube, that is, when air conditioner is operating in a normal condition, the expansion and contraction means is positioned in accordance with pressure of the refrigerant tube. The expansion and contraction means pushes the lock/unlock means toward the distal portion thereof from the contact point between the expansion and contraction means and the lock/unlock means. The polygonal portion of the shaft is placed in the center of the width of the wider slot. Here the shaft is able to rotate freely so as to control the operation of the air conditioner.

In the event a crack arises in the refrigerant tube and pressure of refrigerant goes down below the predetermined pressure, and the expansion and contraction means is moved by the spring which also pushes the lock/unlock means toward the proximal portion thereof. The narrower slot of the lock/unlock means engages the polygonal portion of the shaft so that the shaft can not be rotated. This results in illustrating the presence of the abnormal pressure condition of the refrigerant in the air conditioner.

DETAILED DESCRIPTION OF THE PREFERRED EMBODIMENT

Figure 1:
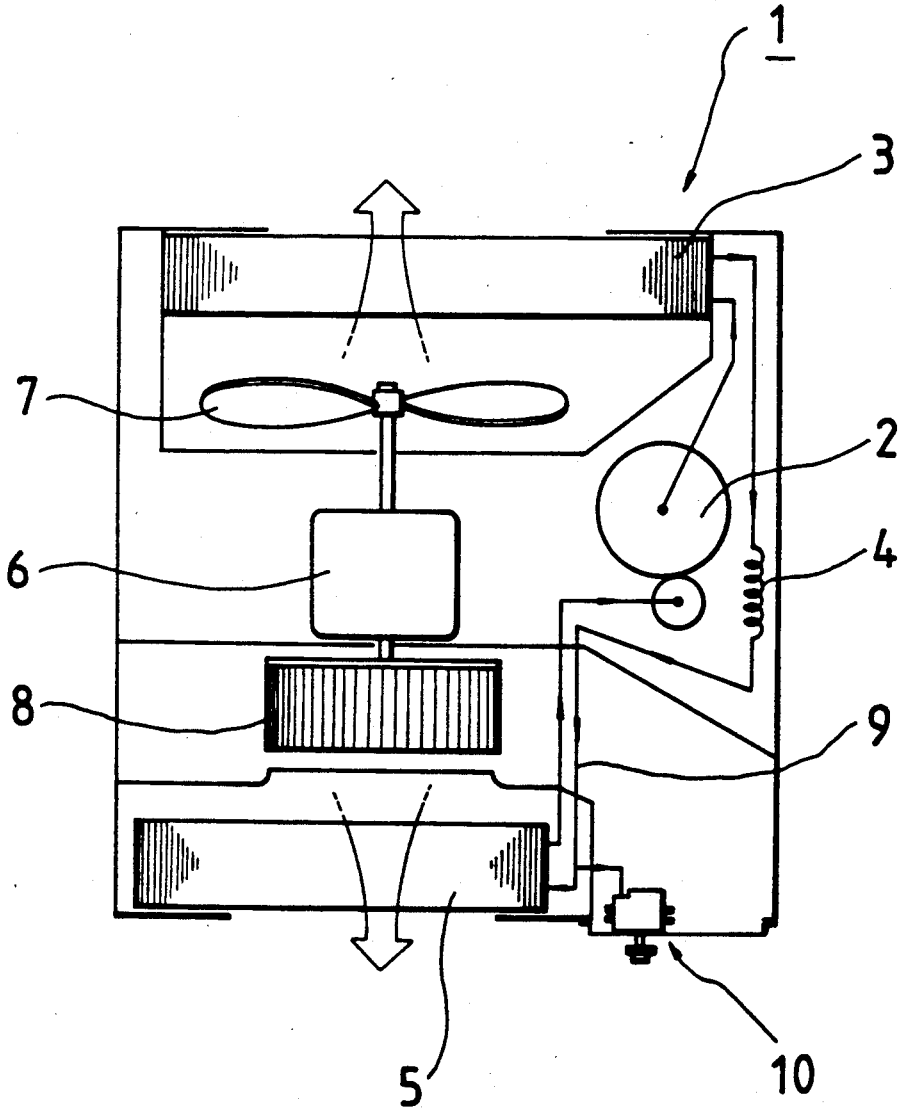
FIG. 1 is a top view illustrating the air conditioner having a control switch according to the present invention.
Figure 2:
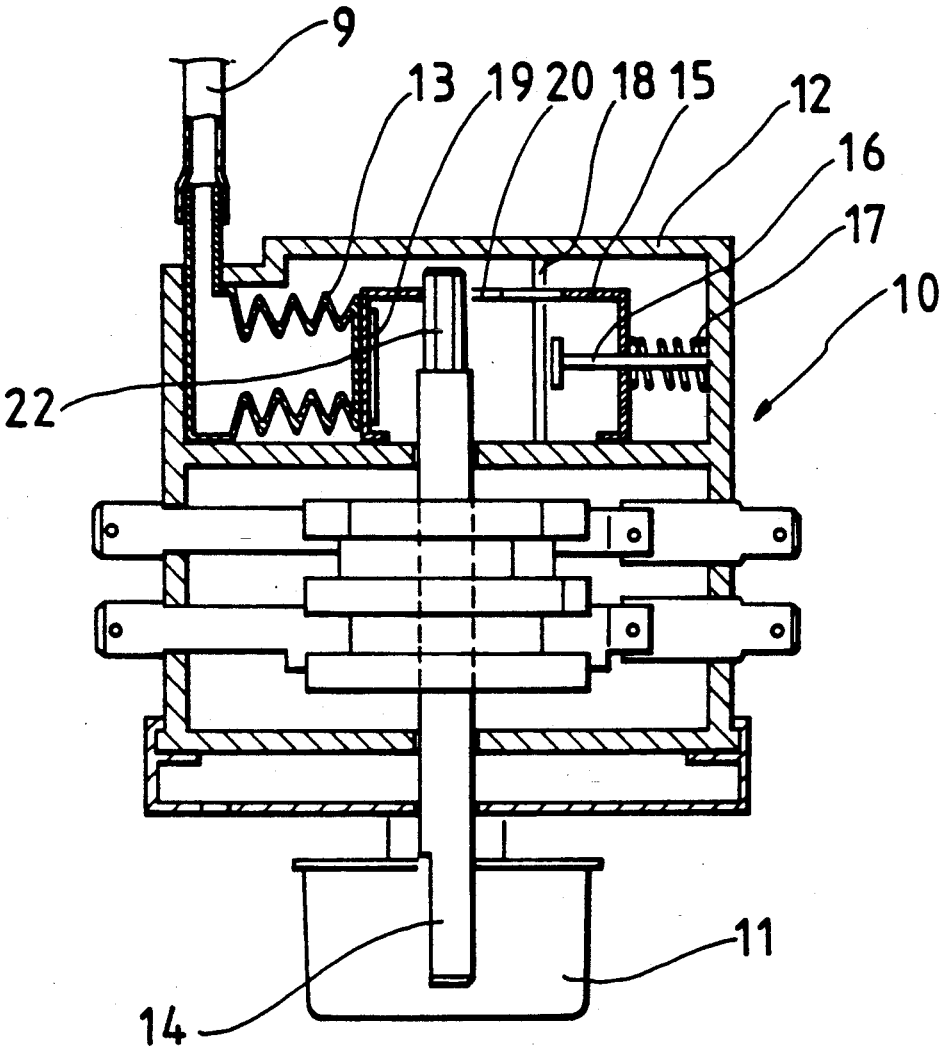
FIG. 2 is a sectional view of the control switch according to the present invention.
Figure 3:
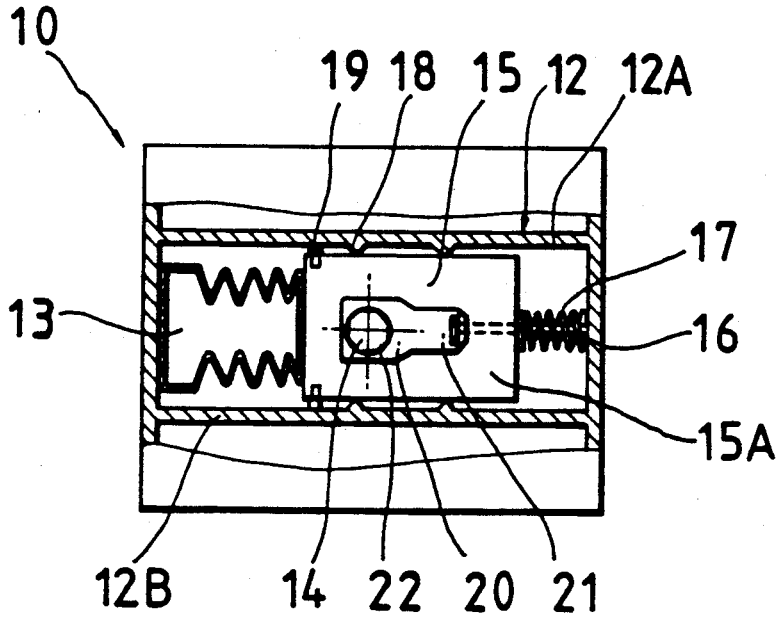
FIG. 3 is a partial sectional top view of the control switch according to the present invention when in the normal refrigerant pressure.

FIG. 1 illustrates the air conditioner with the control switch in accordance with the preferred embodiment of the present invention. The air conditioner 1 is provided with a compressor 2 which includes refrigerant circulating a refrigerant tube, a condenser 3 for condensing the refrigerant, a capillary tube or expansion tube 4 for allowing the compressed refrigerant to expand, and an evaporator 5 for transferring heat from the refrigerated space. Further, between the evaporator 5 and the condenser 3 a fan 7 and a blower 8 are disposed. A motor 6 rotatably powers the bower 8 and the fan so as to forcibly transfer heat to the indoors and outdoors, respectively. In the front, near the bottom of the air conditioner, is located the control switch 10 which controls the operation of the air conditioner. FIG. 2 illustrates the control switch in accordance with the preferred embodiment of the present invention. The control switch 10 comprises a housing 12, a bellow 13 which can expand and contract according to the refrigerant pressure in tube 9. In the moving portion or front portion of the bellow 13 is disposed a lock/unlock means 15 which can move longitudinally in cooperation with the bellow 13. At the opposite face of the lock/unlock means 15 is provided a spring 17 which is always in contact with the lock/unlock means 15. In the symmetric hollow of the spring 17 is provided a support rod 16 for guiding longitudinal movement of the spring 17. In the upper flat portion 15A of the lock/unlock means 15 a slot is formed which comprises a wider width longitudinal slot 20 and a narrower width longitudinal slot 21. The wider slot 20 is proximate relative to the bellow 13, the narrower slot 21 is distal relative to the bellow 13 and between the slots 20, 21 is the tapered transition portion. An operation shaft 14 is provided in the housing 12. At the distal end of the shaft 14 is provided an equal hexagonal portion 22 which extends through the wider slot 20. The operation shaft 14 which extends out of the housing 12 terminates in a knob 11 which aids in rotating the shaft 14. The width of the hexagonal portion 22 of shaft 14 substantially corresponds to the width of the narrower slot 21, as shown in FIG. 3, minus a small clearance, to ensure displacement of the lock/unlock means 15. Whereas, the width of the wider slot 20 substantially corresponds to the diameter of the shaft 14 shown as FIG. 3, plus a small clearance, to ensure lock free rotation of the shaft 14 in the wider slot 20. To ensure even movement of the lock/unlock means 15, three or more protrusions 18 are constructed in an upper side wall 12A and a lower side wall 12B of the housing. Further, to prevent contact between the left edge of the wider slot 20 and the hexagonal portion 22, two stoppers 19 are positioned in the upper side wall 12A and the lower side wall 12B, respectively.

In normal operation of the air conditioner, pressured refrigerant, with the predetermined value, feeds in the bellow 13 through the refrigerant tube 9. As the bellow 13 is expanding, the lock/unlock means 15 moves in a right hand direction as shown in FIGS. 2 and 3. Due to the protrusions 18 in the side walls 12A, 12B, the lock/unlock means 15 travels in a straight manner. When reaching the predetermined pressure, the lock/unlock means 15 can no longer move due to the stopper 19. Therefore, the hexagonal portion 22 of the shaft 14 is positioned in the approximated center of the wider slot 20, and the shaft 14 can freely rotate so as to set the desired operating value.

Figure 4:
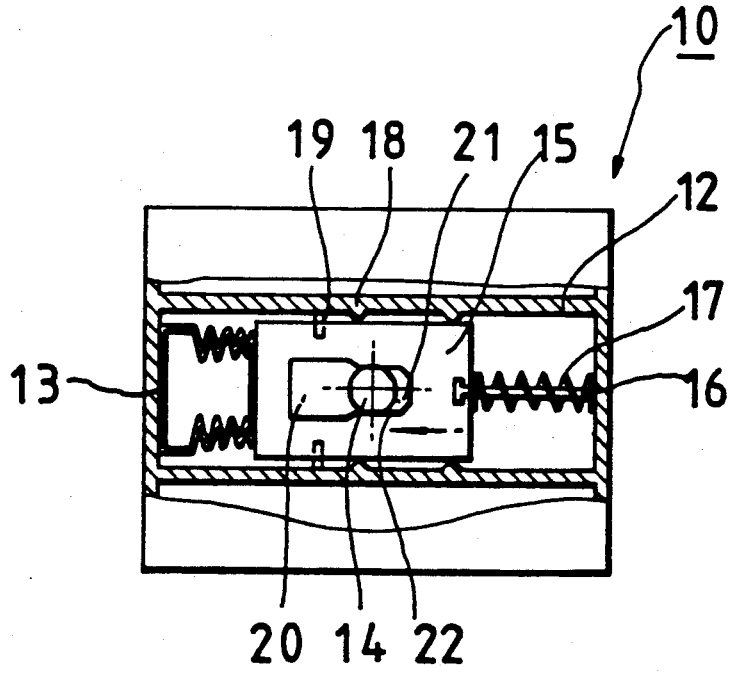
FIG. 4 is a partial sectional top view of the control switch according to the present invention when in the abnormal refrigerant pressure.

When the pressure of the refrigerant in the tube 9 is below the predetermined value, that is, when the refrigerant in the tube 9 is less than the predetermined quantity of refrigerant is leaking through a crack or other container failure of the tube, the lock/unlock means 15 moves in a left hand direction as shown in FIG. 4 with the aid of the force of the spring 17. The spring expends along the axial direction of the rod 16 such that the straight even movement of the lock/unlock means 15 is achieved. The protrusions 18 also contribute to the straight even movement of the lock/unlock means 15. The narrower slot 21 of the lock/unlock means 15 engages the hexagonal portion 22 of the shaft 14 as a result of such movement. The taper of the portion between the two slots or mouth of the narrower slot 21 helps in directing smooth engagement of the narrower slot 21 with the hexagonal portion 22. Therefore, the shaft 14 is rotatably locked by the engagement with narrow slot 21. This results in an awareness of the abnormal situation regarding the circulation of refrigerant upon an attempt to change or rotate the knob 11 by the operator of the air conditioner or the like.

Figure 5:
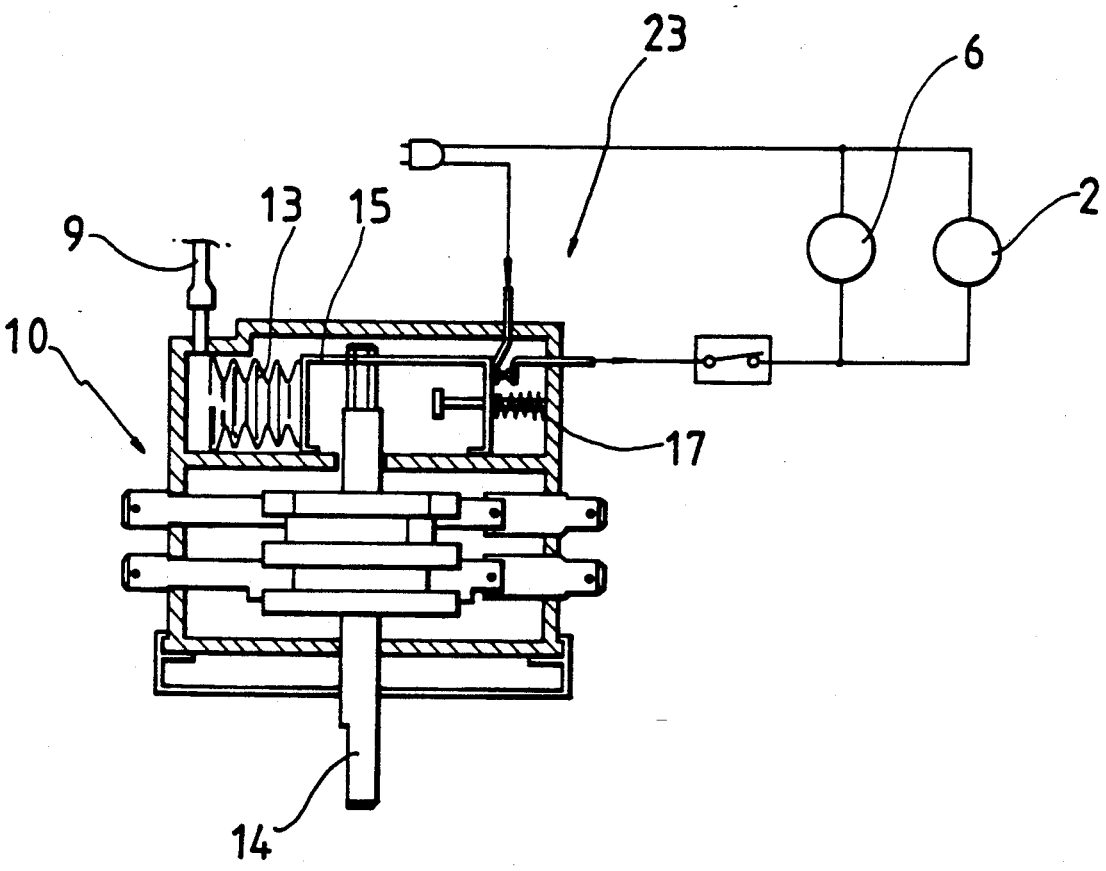
FIG. 5 is an another embodiment of the control switch according to the present invention.

FIG. 5 illustrates another embodiment of the control switch according to the present invention. At the distal side wall of the lock/unlock means 15 relative to the bellow 13 an electrical contact terminal 23 is positioned which operates relative to the movement of the lock/unlock means 15. One of the contact points of the terminal 23 is secured to the side wall of the lock/unlock means 15, and the other of the contact point of the terminal 23 is positioned the facing side wall of the housing 12 to electrically connect the motor 6 and the compressor 2 to the power circuit. When the pressure in the refrigerant tube 9 is normal, the bellow 13 expands itself and pushes the lock/unlock means 15 in a right hand direction so as to maintain electrical contact of terminal 23, thereby continuing the operation of the motor 6 and the compressor 2. In the event that the pressure in the refrigerant tube 9 is abnormally low due to refrigerant leakage from the tube, the bellow 13 contracts and the lock/unlock means 15 moves in a left hand direction due to the force of the spring 17 so as to discontact the contact points of terminal 23. Thus, the operation of the motor and the compressor discontinues.

In the embodiment of the present invention, through the polygonal portion of the shaft comprises hexagonal surfaces, this does not restrict the number of the sides which comprise the polygon. More surfaces than these of a hexagon will achieve the benefits of the present invention as long as the number of the polygonal portion is an even number. Such structure achieves smooth fitting of the narrower slot of the lock/unlock means with the polygonal portion of the shaft.

What is claimed is:

1. In a control switch having a rotatable shaft which operates an air conditioner, the control switch comprising:

a housing;

an expansion and contraction means disposed in said housing and operatively connected to a pressured refrigerant pipe so as to exhibit expansion and contraction according to the pressure of the refrigerant to said expansion and contraction means;

a lock/unlock means slidably disposed in said housing so as to longitudinally exhibit movement according to expansion and contraction of said expansion and contraction means for locking/unlocking the rotation of said shaft; and a spring disposed in said housing for forcing said lock/unlock means to the lock portion.

2. The control switch according to claim 1, wherein said lock/unlock means comprises an unlock slot formed at a proximal position relative to said expansion and contraction means and a lock slot formed at a distal position relative to said expansion and contraction means, said unlock slot constituting a wider width than that of said lock slot, and with a tapered transition between said slots.

3. The control switch according to claim 2, wherein a polygonal portion is formed at a distal end portion of said shaft so as to engage said lock slot to prevent rotation of said shaft.

4. The control switch according to claim 3, wherein said polygonal portion constitutes six or more even numbered sides.

5. The control switch according to claim 1, wherein an electrical contact terminal is provided at the distal side wall of said lock/unlock means from said expansion and contraction means for operating relative to the movement of said lock/unlock means.

6. The control switch according to claim 1 further including contact point to define a contact terminal with one contact point provided on the side wall of said lock/unlock means, and the other of said contact point provided on the facing side wall of said housing.

* * * * *